US006415618B1

(12) United States Patent
Sul et al.

(10) Patent No.: US 6,415,618 B1
(45) Date of Patent: Jul. 9, 2002

(54) DEVICE FOR DETECTING FULL DEHUMIDIFIER WATER TANK

(75) Inventors: Dong Hyun Sul, Kyongsangbuk-do; Nam Seob Eom, Seoul, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/891,411

(22) Filed: Jun. 27, 2001

(30) Foreign Application Priority Data

Aug. 30, 2000 (KR) ..... 2000-50799
Nov. 29, 2000 (KR) ..... 2000-71707

(51) Int. Cl.[7] ..... F25D 21/14
(52) U.S. Cl. ..... 62/188; 62/291
(58) Field of Search ..... 62/188, 291, 285, 62/288; 141/198, 199; 340/625; 73/317

(56) References Cited

U.S. PATENT DOCUMENTS 3,110,161 A * 11/1963 Maleck ..... 200/61.04
4,181,021 A * 1/1980 Harris et al. ..... 73/317
4,712,382 A * 12/1987 LeClear ..... 141/198
5,850,175 A * 12/1998 Yeilding ..... 200/84 R
6,341,524 B1 * 1/2002 Nagase et al. ..... 116/229

* cited by examiner

*Primary Examiner*—William E. Tapolcai
(74) *Attorney, Agent, or Firm*—Birch, Stewart, Kolasch & Birch, LLP

(57) ABSTRACT

Dehumidifier including a water tank under a cabinet for storage of condensate dropped from a heat exchanger, a vertical barrier in front of the water tank for separating a space, a fixing guide fitted to a fitting hole on a top surface of the water tank, a floater rotatably fitted to the fixing guide for being rotated by buoyancy, and detection means fitted to one side of the barrier for detection of full water tank as the floater rotates, thereby detecting a full water tank more, accurately.

22 Claims, 8 Drawing Sheets

DEVICE FOR DETECTING FULL DEHUMIDIFIER WATER TANK

BACKGROUND OF THE INVENTION

1. Field of the Invention

The present invention relates to a device for detecting a full dehumidifier water tank, and more particularly, to a device for detecting a full dehumidifier water tank, which can detect a full water tank, more accurately.

2. Background of the Related Art

In general, the dehumidifier removes moist from room air during the room air passes through an evaporator by means of refrigerating cycle before the room air is discharged to a room, for maintaining the room comfortable. A related art dehumidifier will be explained with reference to FIGS. 1 and 2. FIG. 1 illustrates a disassembled perspective view of a related art dehumidifier, and FIG. 2 illustrates an inner structure of a related art dehumidifier schematically, provided with a cabinet 1, a heat exchanger 4 in the cabinet 1 having an evaporator 2 and a condenser 3 for removing moist, and a fan 5 next to the heat exchanger 4 for forced circulation of the room air. The cabinet has an air inlet fitted with a filter for removing foreign matters in drawn air, and an air outlet fitted with a front grill 7 for discharging air having the moist removed therefrom. There are a base plate 8 fitted under a bottom of the cabinet 1, and a barrier 9 standing on the base plate 8, and, on both sides of the barrier 9, there are a water tank 11 for collecting water removed from the heat exchanger 4, and a compressor 10 for circulating refrigerant through the evaporator 2 and the condenser 3. There is a drain hole 12 under the heat exchanger 4 for collecting condensate formed during dehumidification and discharging to the water tank 11. The water tank 11 has grooves 11*a* in both sides of outer surfaces thereof for rotation of a preset angel when the water tank is full, and the barrier 9 has projections 9a for being caught at the grooves 11*a*.

The room air is drawn into the foregoing related art dehumidifier through the air inlet as the compressor 10 and the fan 5 are put into operation, has moist therein removed as the room air passes through the heat exchanger 4 having the evaporator 2 and the condenser 3, and discharged to the room through the front grill 7 fitted to the air outlet. The condensate from the evaporator 2 flows to and collected in the water tank 11 through the drain hole 12. Thus, as a water level of the water tank 11 becomes the higher gradually, the water tank 11 rotates in a clockwise direction on the drawing centered at the projections 9*a* on the barrier 9 as the compression spring 17 is compressed by the condensate, until the water tank 11 is full when the water tank 11 pushes a lower end of a plate spring 13 fitted to the barrier 9, which actuates a microswitch 15, that facilitates to detect the water tank 11 full.

However, the related art device for detecting a full dehumidifier water tank has the following drawbacks.

The related art dehumidifier is required to have nothing in a path of rotation of the water tank 11 because the full water tank is detected when the water tank 11 rotates by weight of the collected condensate. That is, since a space is required enough to avoid interference when the water tank 11 rotates and tilts backward, there is a limitation with respect to space in the installation of the dehumidifier. Moreover, as the device for detecting a full dehumidifier water tank is fitted at a lower part of the water tank 11, there is a problem of reliability of detection because the water tank might rotate owing to washing of the condensate even if the water tank is not full, which causes an erratic detection of a full water tank. In the meantime, even though the tension of the compression spring 17 and the plate spring 13 required to be set exactly for rotation of the water tank 11 in proportion to a water level, there is a limitation of an exact detection of the full water tank because the setting is not easy. Furthermore, resetting of tension of the plate spring 13 is not easy when it is required to change the water level to be detected.

SUMMARY OF THE INVENTION

Accordingly, the present invention is directed to a device for detecting a full dehumidifier water tank that substantially obviates one or more of the problems due to limitations and disadvantages of the related art.

An object of the present invention is to provide a device for detecting a full dehumidifier water tank, which permits easy detection of a full water tank, and easy setting change of the water tank level.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the dehumidifier includes a water tank under a cabinet for storage of condensate dropped from a heat exchanger, a vertical barrier in front of the water tank for separating a space, a fixing guide fitted to a fitting hole on a top surface of the water tank, a floater rotatably fitted to the fixing guide for being rotated by buoyancy, and detection means fitted to one side of the barrier for detection of full the floater rotates.

The foregoing device for detecting a full dehumidifier water tank of the present invention can make a stable and accurate detection of a full water tank because the floater is operative in proportion to a buoyancy by a water level.

By adjusting a length of the floating part, an amount of full water tank can be changed with easy.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
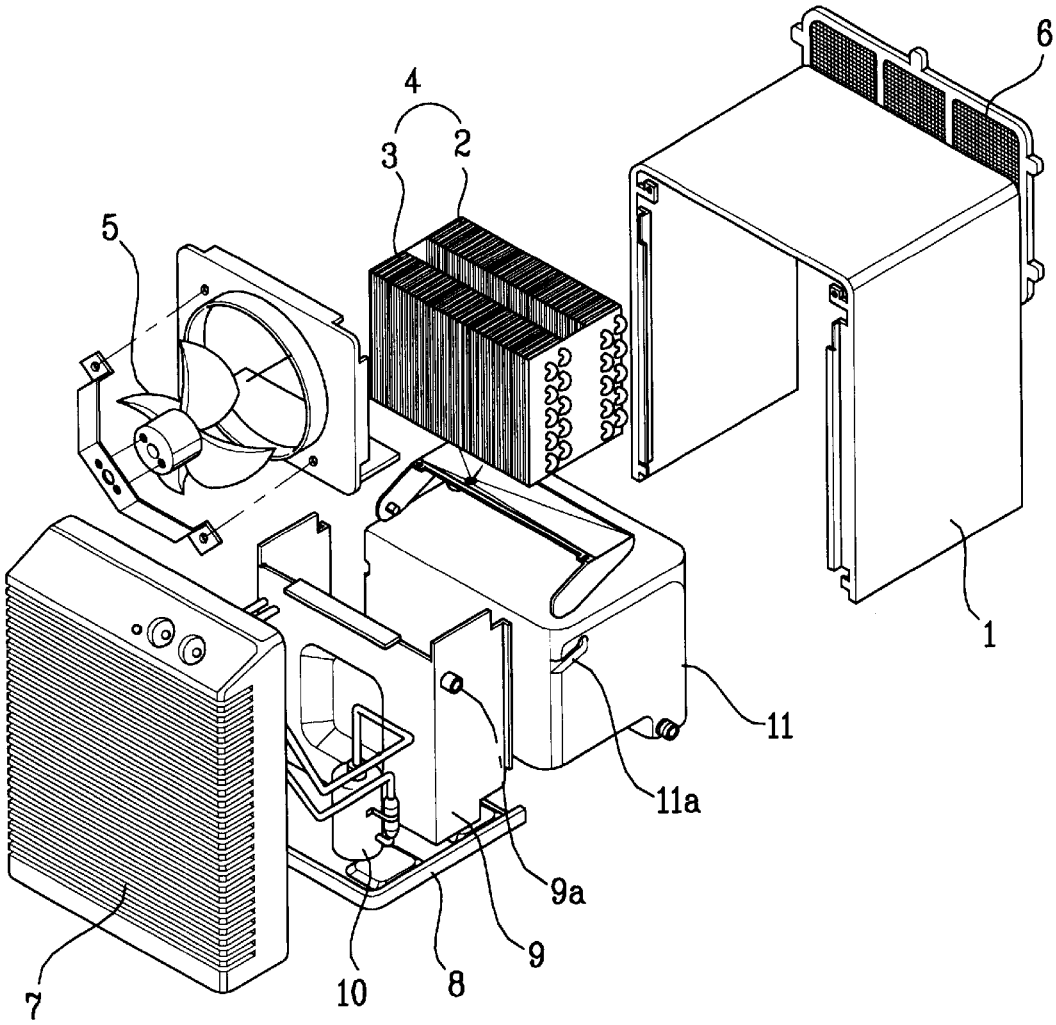
FIG.1 Related Art
FIG. 1 illustrates a disassembled perspective view of a related art dehumidifier.
Figure 2:
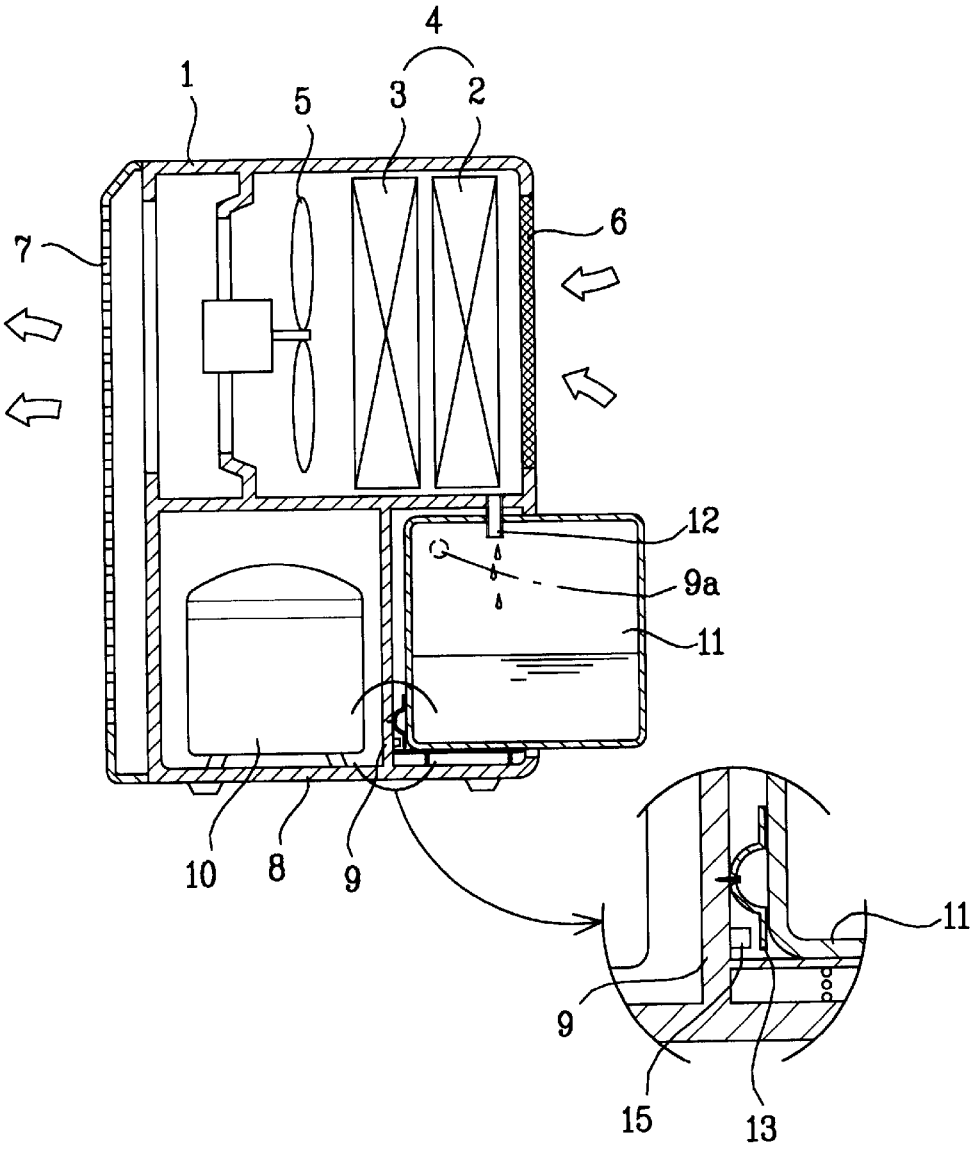
FIG.2 Related Art
FIG. 2 illustrates a section of an inner structure of a related art dehumidifier schematically.
Figure 3:
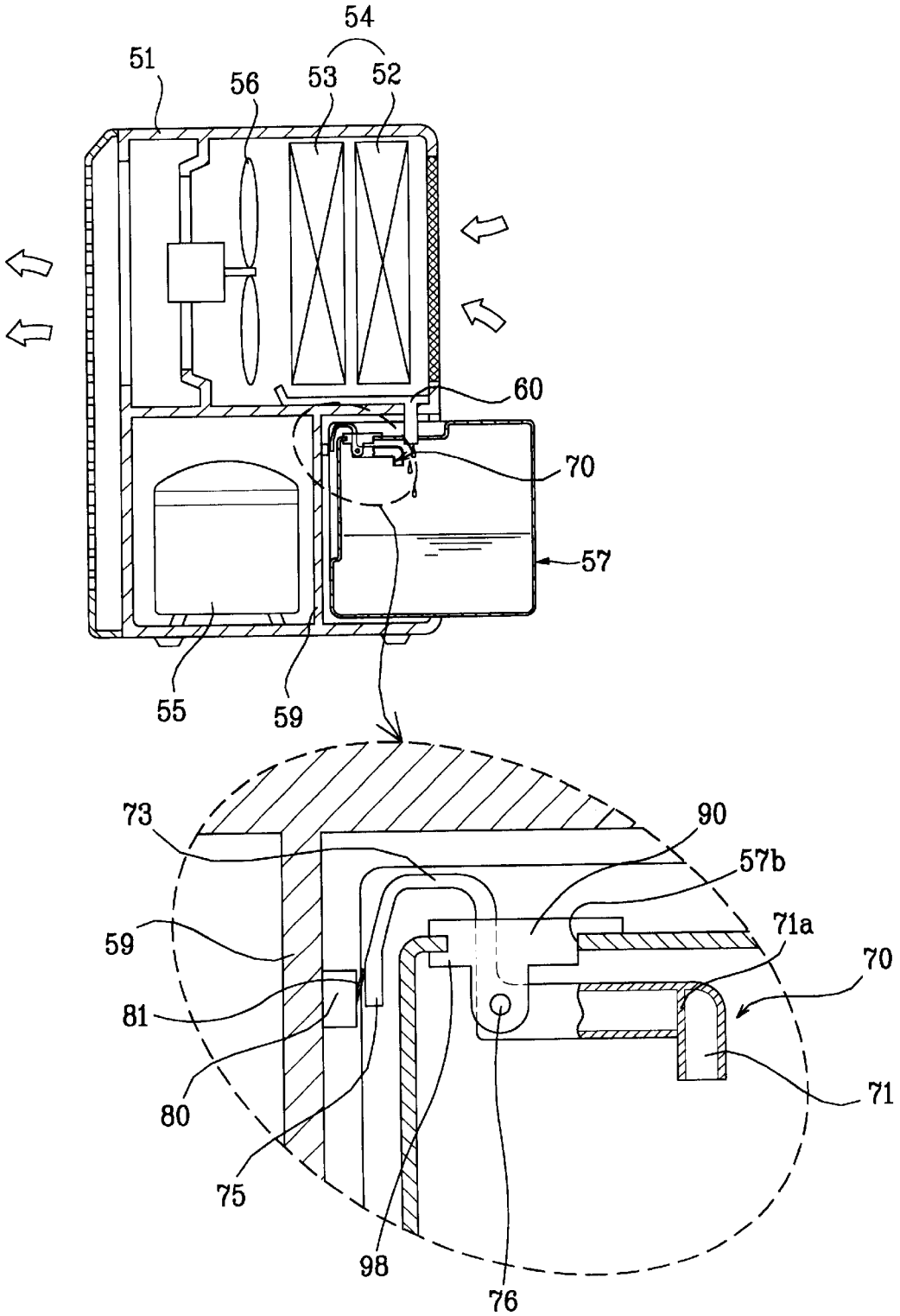
FIG. 3 illustrates a section of a dehumidifier having a device for detecting a full dehumidifier water tank in accordance with a first preferred embodiment of the present invention.

Reference will now be made in detail to the preferred embodiments of the present invention, examples of which are illustrated in the accompanying drawings. A first embodiment device for detecting a full dehumidifier water tank will be explained with reference to FIGS. 3~7. FIG. 3 illustrates a section of a dehumidifier having a device for detecting a full dehumidifier water tank in accordance with a first preferred embodiment of the present invention.

Referring to FIG. 3, the dehumidifier having a device for detecting a full dehumidifier water tank in accordance with a first preferred embodiment of the present invention includes a cabinet 51 having an air inlet and an air outlet in a front and a rear surfaces respectively, a barrier 59 fitted to a central portion of an inside space of the cabinet 51 for dividing the inside space of the cabinet 51 to provide various components therein, a fan 56 for mounting above the barrier 59 for forced suction of the room air, a heat exchanger 54 having a condenser 53 and an evaporator 52 mounted inside of the air inlet for removing moist from the room air drawn by the fan 56, a compressor 55 mounted in front of the barrier 59 for compressing the refrigerant circulating the heat exchanger 54 to high temperature and pressure to form a refrigerating cycle, a drain pan 60 under the heat exchanger 54 for collecting condensate on the heat exchanger 54 and making the condensate to flow one side, a water tank 57 under the drain pan 60 in rear of the barrier 59 for temporary storage of the condensate from the drain pan 60 and discharge to outside of the dehumidifier, a floater in an upper part of the water tank 57 for being rotated centered on a hinge as the floater is buoyant, and a micro switch fitted to one side of the barrier 59 for providing a full tank signal in association with the floater when the floater is rotated as the water tank is full.

Figure 4:
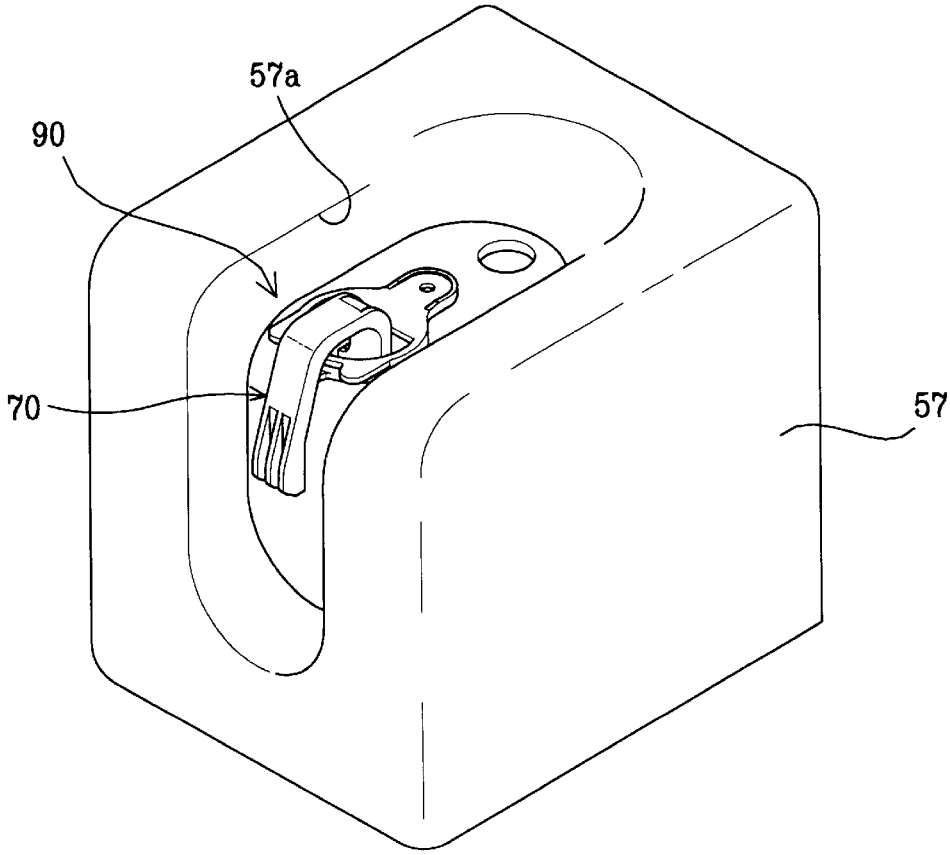
FIG. 4 illustrates a perspective view of a dehumidifier water tank having a device for detecting a full dehumidifier water tank in accordance with a preferred embodiment of the present invention fitted thereto.
Figure 5:
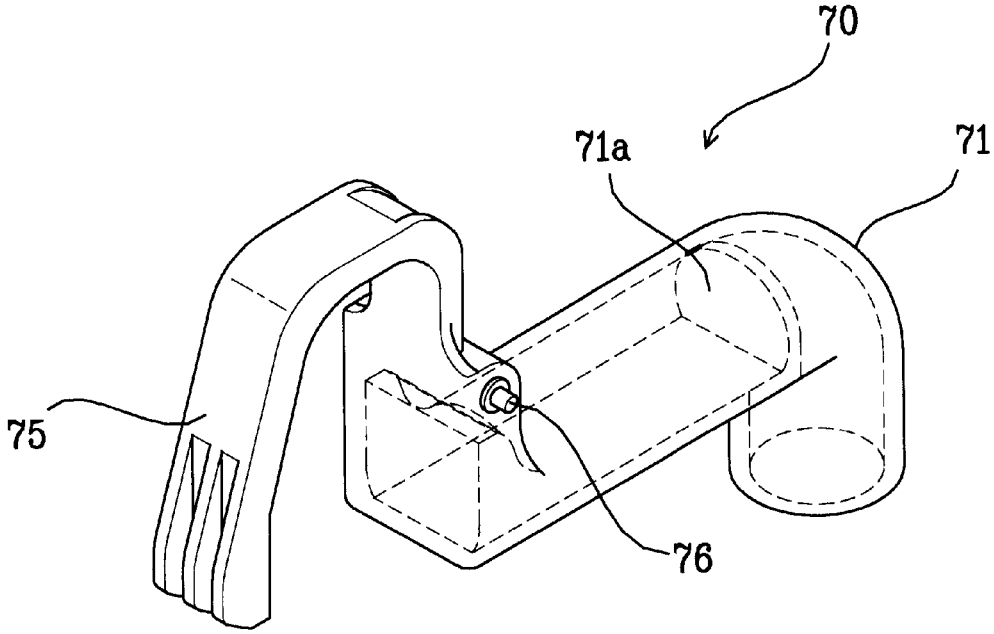
FIG. 5 illustrates a disassembled perspective view of the device for detecting a full dehumidifier water tank in FIGS. 3 and 4.
Figure 5:
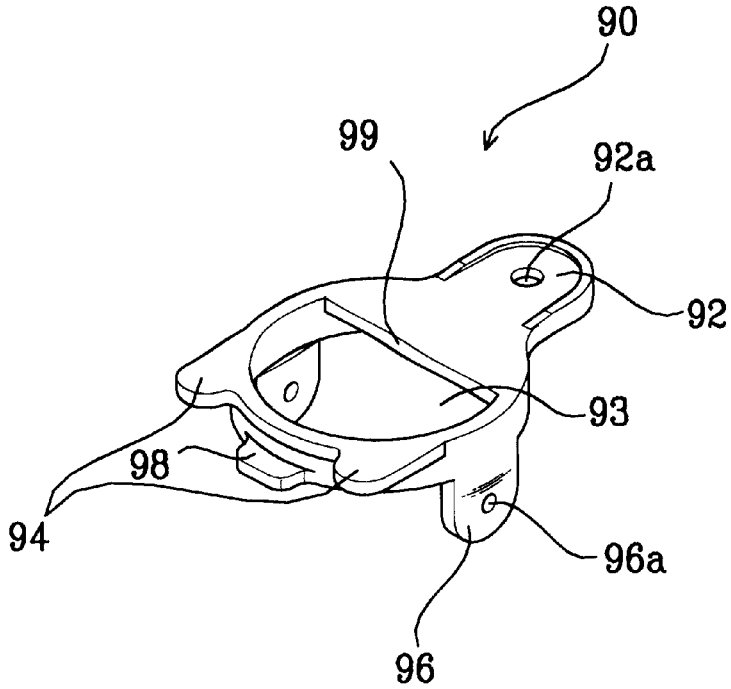
Figure 6:
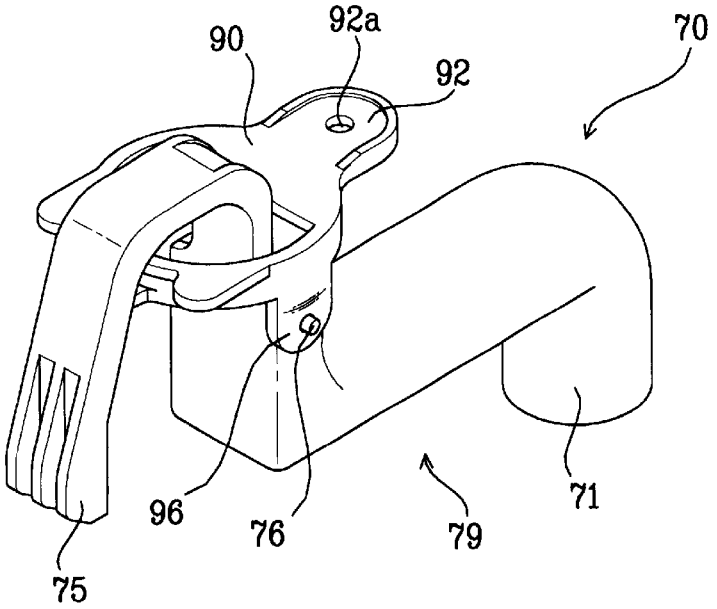
FIG. 6 illustrates an assembled perspective view of FIG. 5.

FIG. 4 illustrates a perspective view of a dehumidifier water tank having the device for detecting a full dehumidifier water tank in FIG. 3 fitted thereto, and FIG. 5 illustrates a disassembled perspective view of the device for detecting a full dehumidifier water tank in FIGS. 3 and 4.

Referring to FIGS. 4 and 5, the water tank 57 is substantially hexahedral, and has a recess 57*a* extended from a center of a top surface to one side surface thereof for reducing a space required for the water tank 57, and preventing interference with other members and suffering from damage during operation of the floater, and a fitting hole 57*b* in the recess 57*a*. Though the recess 57*a* extended from a center of a top surface to one side surface of the water tank is formed for fitting the floater in the first preferred embodiment of the present invention, the recess 57*a* may not be formed. There is a displaying means (not shown) connected to the microswitch 80 which is provided for detecting a full water tank and converting it into an electrical signal for presenting the signal from the microswitch to outside of the dehumidifier tank for a user to know. There is a fixing guide 90 fitted in a fitting hole 57*b* in the top surface of the water tank 57 for fitting the floater 70 thereto. The floater 70 includes a floating part 71 in the water tank 57 for providing buoyancy, and lever part 75 extended from the floating part 71 to position outside of the water tank 57 and bent toward the microswitch 80 for rotating in association with rotation of the floating part 71, to come into contact with the microswitch 80. The lever part 75 is in a "∩" form so that the lever part 75 can contact with the microswitch fitted to the barrier while the lever part 75 avoids interference with a front surface of the water tank. There are one pair of rotating center projections 76 coupled with the fixing guide 90 on an upper part of the floating part 71 for facilitating rotation of the floater 70. The floating part 71 is a hollow bar in a "□" form to be suitable for providing buoyancy, and has a partition wall 71*a* at a bent part of the floating part 71 for partitioning an inside space of the floating part 71 into an upper space and a lower space, for keeping the floater 70 buoyant even if air in the lower space is lost. That is, the partition wall 71*a* is a secondary safety means. In this instance, the upper space of the floating part 71 separated by the partition wall 71*a* has a semi-cylindrical section, and the lower space of the floating part 71 has a cylindrical section (see FIG. 5). The fixing guide 90 has a ring form substantially for fitting to the fitting hole 57*b* in the water tank, with an opening 93 at a central part of a surface thereof for fitting the floater 70. The opening 93 is semi-circular, with a chord part 99 engaged with an outer surface of the lever part 75 of the floater 70, for serving as a stopper that limits a rotation angle of the floater 70 before the buoyancy is acted thereto. The fixing guide 90 includes a flange part 92 projected to one side in a horizontal direction having a fastening hole 92*a* for fastening the fixing guide 90 to the water tank, one pair of upper supporting pieces 94 formed opposite to the flange part 92 spaced from each other, a lower supporting piece 98 between the one pair of upper supporting pieces 94 and below the one pair of upper supporting pieces 94 as much as a thickness of the water tank for holding an edge of the fitting hole 57*b* in association with the upper supporting pieces 94 when the fixing guide 90 is fitted to the fitting hole 57*b* in the water tank for setting the fixing guide 90 to the water tank, and fixing pieces 96 formed downward perpendicular to the upper supporting pieces 94 having inserting holes 96*a* to be coupled with the rotating center projections 76 on the floater 70. (see FIG. 5). The display means (not shown) presents a full water tank signal to outside of the dehumidifier for user's sensing by using a signal from the microswitch 80 in a form of a lamp fitted to an outside wall of the cabinet 51 or a sound emitter, to provide video and audio signals.

The operation of the foregoing device for detecting a full dehumidifier water tank in accordance with a first preferred embodiment of the present invention will be explained.

Figure 7:
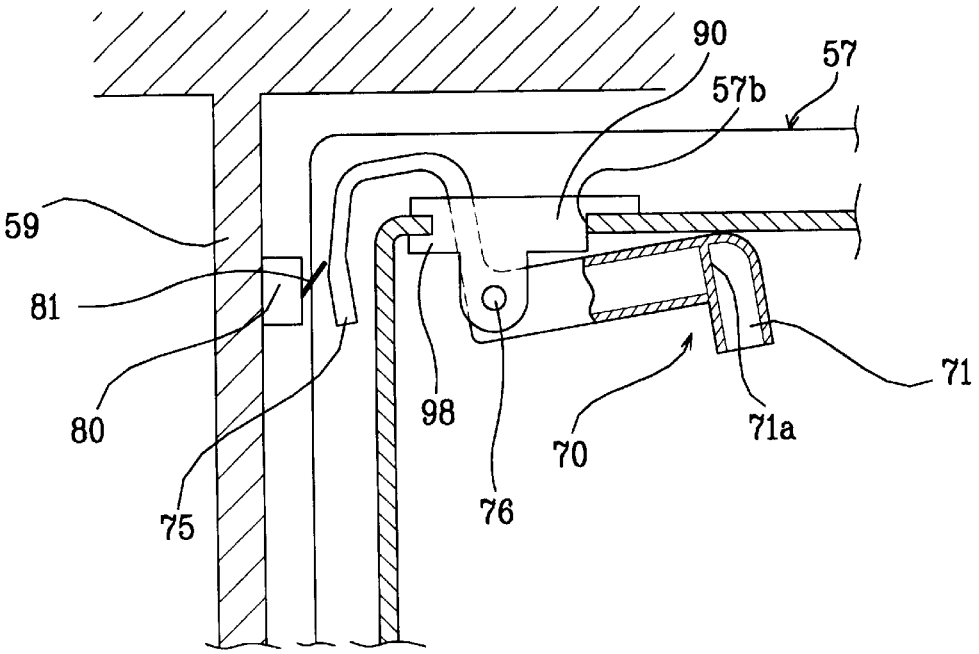
FIG. 7 illustrates a section of key parts for explaining operation of the device for detecting a full dehumidifier water tank in accordance with a first preferred embodiment of the present invention.

Referring to FIG. 3, when a water level of the water tank is low before an adequate buoyancy is provided to the floater, the lever part 75 is in contact with the microswitch 80. When a power is supplied, to put the dehumidifier into operation, the room air is drawn forcibly, involved in removal of moist as the room air passes through the heat exchanger 54, and discharged through the air outlet. The condensate formed by heat exchange of the heat exchanger 54 is collected at the drain pan 60, and flows into the water tank 57, and, when the water level in the water tank 57 rises owing to continued operation, the floater 70 rotates centered on the rotating center projections 76 in a counter clockwise direction on the drawing by the buoyancy to the floating part 71. In this time, as shown in FIG. 7, the lever part 75 is also rotated in the counter clockwise direction, to move away from the microswitch 80 to generate a full tank signal, that is presented to the display means (not shown) so that the user discharges the condensate collected in the water tank 57. When the air in the lower space of the floating part 71 is lost owing to washing of the condensate in the water tank, to cause a level of the condensate to rise more, detection of the full water level is still available as the buoyancy acts onto the upper space of the floater separated by the partition wall 71*a,* to rotate the floater, that in turn activates the microswitch. Accordingly, the upper space of the floater of the present invention acts as a secondary safety device.

In the meantime, in the foregoing embodiment, though a system is explained as an example, in which the full water tank signal is generated as the lever part 75 moves away from the microswitch, opposite to this, it is also possible that a system may be provided, in which the full water tank signal is generated as the lever part 75 is brought into contact with the microswitch 80 as the floater 70 rotates when the water tank is full, while the lever part 75 is kept away from the microswitch 80 when the water level is not full.

The forgoing first embodiment device for detecting a full dehumidifier water tank of the present invention has the following advantages.

As the floater is operative in proportion to the buoyancy coming from the water level, an accurate, and stable detection of a full water of the water tank is made available.

Easy change of full water tank level to be detected is made available by adjusting a length of the floating part 71.

Figure 8:
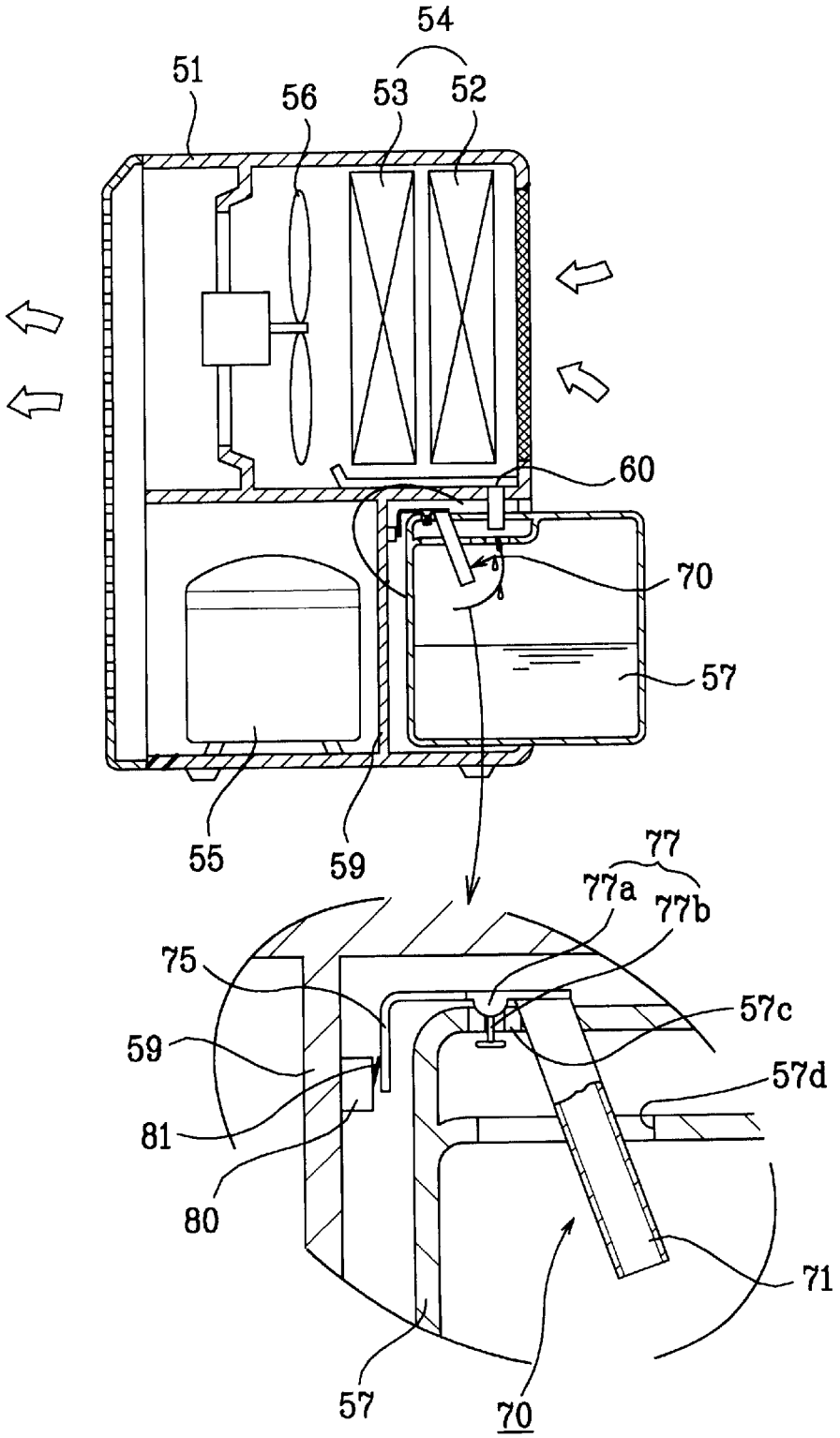
FIG. 8 illustrates a section of a dehumidifier having a device for detecting a full dehumidifier water tank in accordance with a second preferred embodiment of the present invention.
Figure 9:
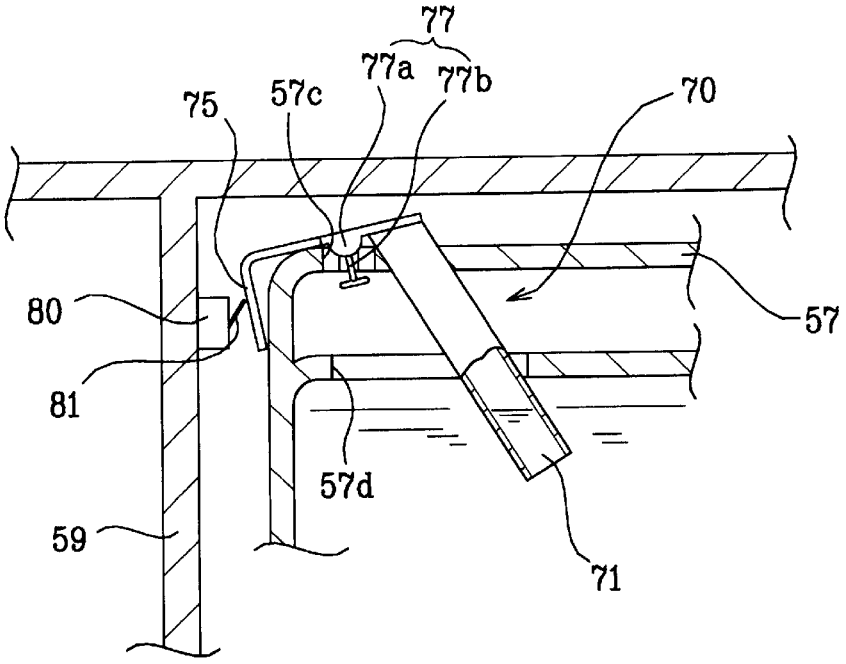
FIG. 9 illustrates a section of key parts for explaining operation of the device for detecting a full dehumidifier water tank in accordance with a second preferred embodiment of the present invention; and, FIG. 10 illustrates a disassembled perspective view of a dehumidifier water tank having the device for detecting a full dehumidifier water tank in FIG. 8 provided thereto.
Figure 10:
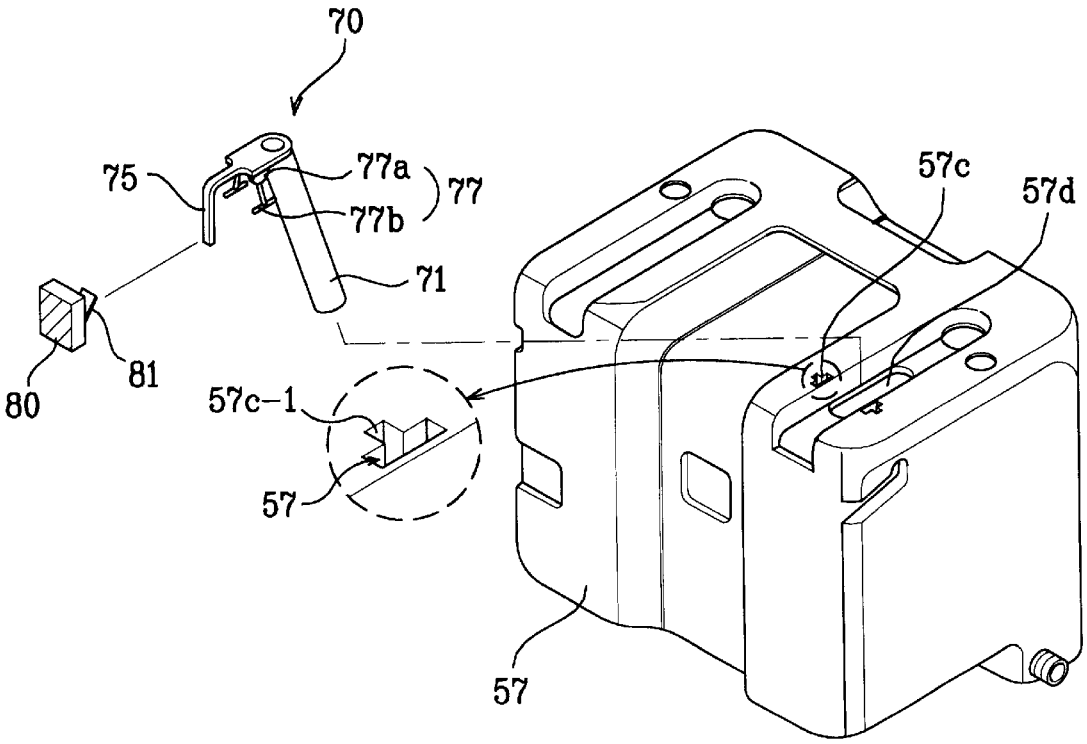

A device for detecting a full dehumidifier water tank in accordance with a second preferred embodiment of the present invention will be explained, with reference to the attached drawings. FIG. 8 illustrates a section of a dehumidifier having a device for detecting a full dehumidifier water tank in accordance with a second preferred embodiment of the present invention, showing a state before full water tank, FIG. 9 illustrates a section of key parts for explaining operation of the device for detecting a full dehumidifier water tank in accordance with a second preferred embodiment of the present invention at a full water tank, and FIG. 10 illustrates a disassembled perspective view of a dehumidifier water tank having the device for detecting a full dehumidifier water tank in FIG. 8 provided thereto.

Referring to FIG. 8, the dehumidifier having a device for detecting a full dehumidifier water tank in accordance with a second preferred embodiment of the present invention includes a heat exchanger 54 having an evaporator 52 and a condenser 53 in a cabinet 51 for removing moist, and a fan 56 next to the heat exchanger 54 for forced circulation of room air. There are a compressor 55 in a lower part of the cabinet 51 for circulating refrigerant through the evaporator 52 and the condenser 53, a water tank 57 for storage of water formed by dehumidification action of the heat exchanger 54, and a vertical barrier 59 fitted between the compressor 55 and the water tank 57 for separating two spaces. There is a drain pan 60 between the heat exchanger 54 and the water tank 57 for discharging condensate dropped from the evaporator 52 to the water tank 57. Particularly, there are a stick type floater 70 of a hollow stick with an opened lower part fitted to an upper surface of the water tank 57 and inserted in the water tank 57 for rotating along with a water level, and a microswitch 80 fitted to the barrier 59 for detecting the full of the water tank 57 as the stick type floater 70 is brought into contact with, or moves away from the microswitch 80 when the stick type floater 70 is rotated. The stick type floater 70 of a hollow stick with an opened lower part includes a floating part 71 for inserting in the water tank 57 downward, a lever part 75 sealing a top part of the floating part 71 and extended toward a microswitch direction and bent, and a rotating center 77 projected from the lever part 75 and fitted to a top part of the water tank 57 for being a rotation center as the water level varies. As shown in FIG. 5, the rotating center 77 includes two spaced semi-circular rotating parts 77*a* projected from a bottom of the contact lever part 75, and two catches 77*b* extended from lower ends of the rotating parts 77*a* and opened to each other for insertion in an inside of the water tank 57 for preventing the floater from falling off the water tank 57. The water tank 57 has two "T" formed fitting holes 57*c,* and an elongated hole 57*d* between the two fitting holes 57*c* for free rotation of the floater 70 when the floating part 71 is provided with buoyancy in a state the floater 70 is fitted to the water tank. Accordingly, when the floater 70 is assembled to the water tank, the two catches 77*b* are pressed inward to bring the catches 77*b* closer, inserted into the "T" formed fitting holes 57*c,* and released, to be caught at catch holes 57*c*-l of the fitting holes 57*c* as the catches 77*b* are opened by an elastic restoration force.

The operation of the second embodiment device for detecting a full dehumidifier water tank of the present invention will be explained.

Referring to FIG. 3, under a state the water tank 57 is not full, the stick type floater 70 is not rotated, when the lever part 75 is in contact with a terminal 81 of the microswitch 80. As shown in FIG. 4, under this state, if a water level in the water tank 57 rises, the water level also rises in the floating part 71, to compress the air inside of the floating part 71 and provide buoyancy to the entire stick type floater 70, such that the stick type floater 70 rotates centered on the rotating center part 77, when the lever part 75 moves away from the terminal 81 of the microswitch 80, that generates a full water tank detection signal. Of course, opposite to this, the system may be made such that the lever part 75 is disposed away from the terminal 81 of the microswitch 80 when the water level is not full, and brought into contact with the terminal 81 when the water level is full to rotate the stick type floater 70.

The second embodiment of the present invention has the following advantages.

The hollow stick type floater 70 permits a stable, and accurate detection of the full water tank, and a full water tank level can be adjusted with easy by adjusting a length of the floating part 71. Since the device has a simple structure, fabrication of the device is easy, and, since the floater has a small width, the device can be employed even if a width of the water tank is narrow.

Though a microswitch is employed in the first or second embodiment for detection of full water tank, a photo sensor having a light receiver and a light emitter may be employed instead of the microswitch. That is, the lever part of the floater is made either to cut off a light path to the light receiver, or open a light path to the receiver for detection of full water tank, when the floater is rotated by buoyancy.

It will be apparent to those skilled in the art that various modifications and variations can be made in the device for detecting a full dehumidifier water tank of the present invention without departing from the spirit or scope of the invention. Thus, it is intended that the present invention cover the modifications and variations of this invention provided they come within the scope of the appended claims and their equivalents.

What is claimed is:

1. A dehumidifier comprising:

a water tank under a cabinet for storage of condensate dropped from a heat exchanger;

a vertical barrier in front of the water tank for separating a space;

a fixing guide fitted to a fitting hole on a top surface of the water tank;

a floater rotatably fitted to the fixing guide for being rotated by buoyancy; and, detection means fitted to one side of the barrier for detection of full water tank as the floater rotates.

2. A dehumidifier as claimed in claim 1, wherein the floater includes;

a floating part in the water tank for providing buoyancy, and a lever part extended from the floating part for activating the detecting means when a buoyancy is provided to the floating part.

3. A dehumidifier as claimed in claim 1, wherein the detecting means is a microswitch.

4. A dehumidifier as claimed in claim 1, wherein the detecting means is a photo sensor having a light receiver and a light emitter.

5. A dehumidifier as claimed in claim 2, wherein the floating part includes;

a hollow bar in a vertically elongated form to be suitable for providing buoyancy, and a partition wall at a bent part of the floating part for partitioning an inside space of the floating part into an upper space and a lower space, for keeping the floater buoyant in proportion to a rise of a water level even if air in the lower space is lost.

6. A dehumidifier as claimed in claim 1, wherein the fixing guide has a form of a ring substantially for fitting to a fitting hole in the water tank, and an opening at a central portion of the fixing guide for fitting the floater thereto.

7. A dehumidifier comprising:

a water tank under a cabinet for storage of condensate dropped from a heat exchanger;

a vertical barrier in front of the water tank for separating a space;

a fixing guide fitted to a fitting hole on a top surface of the water tank;

a floater rotatably fitted to the fixing guide for being rotated by buoyancy; and, a microswitch fitted to one side of the barrier for generating a full water tank signal in association with the floater as the floater rotates following the full water tank.

8. A dehumidifier as claimed in claim 7, wherein the floater includes;

a floating part in the water tank for providing buoyancy, and a lever part extended from the floating part to be located outside of the water tank and bent toward the microswitch, for moving along with the floating part so as to be brought into contact with the microswitch.

9. A dehumidifier as claimed in claim 8, wherein the lever part is in an inverted U-shaped form so that the lever part can contact with the microswitch fitted to the barrier while the lever part avoids interference with a front surface of the water tank.

10. A dehumidifier as claimed in claim 8, wherein the floating part includes one pair of rotating center projections on an upper part thereof for coupling with the fixing guide to facilitate rotation of the floater.

11. A dehumidifier as claimed in claim 8, wherein the floating part includes;

a hollow bar in a vertically elongated form to be suitable for providing buoyancy, and a partition wall at a bent part for partitioning an inside space of the floating part into an upper space and a lower space, for keeping the floater buoyant in proportion to a rise of a water level even if air in the lower space is lost.

12. A dehumidifier as claimed in claim 11, wherein the upper space of the floating part separated by the partition wall has a semicircular section, and the lower space of the floating part has a circular section.

13. A dehumidifier as claimed in claim 12, wherein the upper space of the floating part separated by the partition wall has an opened lower part.

14. A dehumidifier as claimed in claim 7, wherein the fixing guide has a form of a ring substantially for fitting to a fitting hole in the water tank, and an opening at a central portion of the fixing guide for fitting the floater thereto.

15. A dehumidifier as claimed in claim 14, wherein the opening is semi-circular, with a chord part engaged with an outer surface of the lever part of the floater, for serving as a stopper that limits a rotation angle of the floater before the buoyancy is exerted thereto.

16. A dehumidifier as claimed in claim 14, wherein the fixing guide includes;

a flange part projected to one side in a horizontal direction having a fastening hole for fastening the fixing guide to the water tank, one pair of upper supporting pieces formed opposite to the flange part spaced from each other, a lower supporting piece between the one pair of upper supporting pieces and below the one pair of upper supporting pieces as much as a thickness of the water tank for holding an edge of the fitting hole in association with the upper supporting pieces when the fixing guide is fitted to the fitting hole in the water tank for setting the fixing guide to the water tank, and fixing pieces formed downward perpendicular to the upper supporting pieces having inserting holes to be coupled with the rotating center projections on the floater.

17. A dehumidifier as claimed in claim 7, wherein the floater includes;

a floating part of a hollow stick with an opened lower part for inserting in the water tank downward, a lever part sealing a top part of the floating part and extended toward a microswitch direction and bent, and a rotating center projected downward from both sides of the lever part and fitted to a top part of the water tank for being a rotation center as the water level varies.

18. A dehumidifier as claimed in claim 17, wherein the rotating center includes;

two rotating parts projected in semicircular forms apart from each other from both sides of a bottom surface of the contact lever part, and two catches for inserting from lower ends of the rotating parts to inside of the water tank for preventing falling off.

19. A dehumidifier as claimed in claim 18, further comprising:

two "T" formed fitting holes in the top surface thereof for inserting the catches; and, an elongated hole between the two "T" holes for free rotation of the floater when a buoyancy is provided to the floating part.

20. A dehumidifier as claimed in claim 7, further comprising:

displaying means fitted either to an outside wall or to an inside of the cabinet for presenting a signal from the microswitch to outside of the dehumidifier.

21. A dehumidifier as claimed in claim 2, wherein the detecting means is a microswitch.

22. A dehumidifier as claimed in claim 2, wherein the detecting means is a photo sensor having a light receiver and a light emitter.

* * * * *